US010260263B2

(12) United States Patent
Hirtsiefer et al.

(10) Patent No.: US 10,260,263 B2
(45) Date of Patent: Apr. 16, 2019

(54) FURNITURE HINGE

(71) Applicant: SAMET KALIP VE MADEN ESYA SAN. VE TIC. A.S., Kirac, Esenyurt-Istanbul (TR)

(72) Inventors: Artur Hirtsiefer, Neunkirchen-Seelscheid (DE); Bernd Rödder, Ruppichteroth (DE)

(73) Assignee: SAMET KALIP VE MADEN ESYA SAN. VE TIC. A.S., Istanbul (TR)

( * ) Notice: Subject to any disclaimer, the term of this patent is extended or adjusted under 35 U.S.C. 154(b) by 0 days.

(21) Appl. No.: 15/512,671

(22) PCT Filed: Sep. 4, 2015

(86) PCT No.: PCT/EP2015/070258
§ 371 (c)(1),
(2) Date: Mar. 20, 2017

(87) PCT Pub. No.: WO2016/045939
PCT Pub. Date: Mar. 31, 2016

(65) Prior Publication Data

US 2017/0292301 A1 Oct. 12, 2017

(30) Foreign Application Priority Data

Sep. 23, 2014 (DE) ..... 10 2014 113 713

(51) Int. Cl.
*E05D 5/00* (2006.01)
*E05D 7/12* (2006.01)
(Continued)

(52) U.S. Cl.
CPC ..... *E05D 7/125* (2013.01); *E05D 3/12* (2013.01); *E05D 5/08* (2013.01);
(Continued)

(58) Field of Classification Search
CPC ..... Y10T 16/554; Y10T 16/5543; Y10T 16/5547; E05D 7/125; E05D 2007/128;
(Continued)

(56) References Cited

U.S. PATENT DOCUMENTS 4,270,240 A * 6/1981 Zernig ..... E05D 5/08 16/250
4,361,931 A * 12/1982 Schnelle ..... E05D 5/08 16/252
(Continued)

FOREIGN PATENT DOCUMENTS

DE 4427293 A1 * 4/1995 ..... E05D 5/08
EP 0610765 A1 8/1994
(Continued)

OTHER PUBLICATIONS

International Search Report issued in connection with PCT Application No. PCT/EP2015/070258 dated Nov. 11, 2015.

*Primary Examiner* — Chuck Y Mah
(74) *Attorney, Agent, or Firm* — Steven M. Shape; Dennemeyer & Associates

(57) ABSTRACT

The invention relates to a furniture hinge (10) with a hinge cup (52) having cup side walls (52.4) which encircle a cup opening at least partially, and having a cup bottom (52.1) which at least partially closes off the hinge cup (52) opposite the cup opening, with a spreading element (70) having two clamping jaws (72.1, 72.2) which at least partially radially enclose the cup side walls (52.4) of the hinge cup (52) and which are connected via a flange (71), and with a lifting arrangement for adjusting at least one of the clamp jaws (72.1, 72.2) between a first position and a second position. Here it is provided that at least one of the clamping jaws (72.1, 72.2) comprises at least one integrally formed spreading extension (76, 78) which, in the transition from the first position into the second position, cooperates with the hinge
(Continued)

cup (52) so that the clamping jaws (72.1, 72.2) are spread. As a result, a furniture hinge is created, which can be produced cost-effectively, and which can be attached rapidly and securely to a piece of furniture.

16 Claims, 5 Drawing Sheets

(51) Int. Cl.
*E05D 5/08* (2006.01)
*E05D 3/12* (2006.01)
*E05D 3/18* (2006.01)
*E05D 7/04* (2006.01)

(52) U.S. Cl.
CPC ..... *A47B 2220/0072* (2013.01); *E05D 3/183* (2013.01); *E05D 7/0407* (2013.01); *E05Y 2600/504* (2013.01); *E05Y 2900/20* (2013.01)

(58) Field of Classification Search
CPC ..... E05D 3/12; E05D 5/08; E05D 5/0276; E05D 5/0223; E05D 7/023; E05D 7/0238; E05D 7/0407; E05Y 2900/20; A47B 2220/0072
See application file for complete search history.

(56) References Cited

U.S. PATENT DOCUMENTS 5,463,796 A * 11/1995 Brustle ..... E05D 5/08 16/383
5,715,577 A * 2/1998 Lautenschlager ..... E05D 5/08 16/383
6,073,311 A * 6/2000 Lautenschlager ..... A47B 95/00 16/383
6,081,970 A * 7/2000 Wasilewski ..... E05D 5/08 16/383
7,480,962 B2 * 1/2009 Takamatsu ..... E05D 5/08 16/258
8,006,348 B2 * 8/2011 Ferrari ..... E05D 5/08 16/383
8,312,597 B2 * 11/2012 Gallasch ..... E05D 5/08 16/383

FOREIGN PATENT DOCUMENTS

EP 0610765 B1 * 4/1996 ..... E05D 5/08
EP 2090731 A2 * 8/2009 ..... E05D 5/08
EP 2090731 A2 8/2009

* cited by examiner

FURNITURE HINGE

CROSS-REFERENCE TO RELATED APPLICATIONS

This application claims priority to German application 102014113713.2, filed Sep. 23, 2014, each of which is hereby incorporated by reference in its entirety.

BACKGROUND OF THE INVENTION

Field of the Invention

The invention relates to a furniture hinge with a hinge cup having cup side walls which encircle a cup opening at least partially, and having a cup bottom which at least partially closes off the hinge cup opposite the cup opening, with a spreading element having two clamping jaws which at least partially radially enclose the cup side walls of the hinge cup and which are connected via a flange, and with a lifting arrangement for adjusting at least one of the clamp jaws between a first position and a second position.

Such a furniture hinge is known from the publication EP 0 610 765 A1. Therein, a hinge cup with a housing which can be inserted into a furniture part is described. The furniture hinge is held in a bore in the furniture part by a holding part made of a viscoelastic material, in particular plastic or rubber. For this purpose, the holding part comprises clamping jaws arranged laterally to the hinge cup, which are pressed on the bore wall by spreading. The clamping jaws are connected by a flange. The spreading is achieved by means of spreading parts arranged between the hinge cup and the clamping jaws and designed as tension rods. The spreading parts are connected to a pivotable bracket arranged outside of the hinge cup and perform a lifting movement, when the bracket is turned down. In the process, arcuate spreading bodies having an approximately triangular cross section, which are arranged on the free ends of the spreading parts, press against the clamping jaws and lead to the spreading movement. The spreading parts are made of metal.

In an alternative embodiment, separately designed clamping jaws made of plastic are attached on the spreading parts. The spreading parts comprise, at the free ends thereof, pressing cams oriented toward the hinge cup, which are pushed away from the hinge cup due to the lifting movement of the spreading parts.

It is disadvantageous here that the clamping parts and the spreading jaws are designed as components to be manufactured separately. This leads to comparatively high costs in the manufacture and in the assembly of the furniture hinge. An additional disadvantage of the arrangement relates to the small possible lifting movement of the spreading parts and thus the small possible spreading of the clamping jaws. The lifting movement is limited by the installation height of the bracket, which determines the maximum distance apart between the rotation axis of the bracket and the mounting of the spreading parts.

It is the object of the invention to provide a furniture hinge which enables a rapid and secure attachment of the furniture hinge on a furniture part and which is at the same time manufactured cost effectively.

The object of the invention is achieved in that at least one of the clamping jaws comprises at least one integrally formed spreading extension which, in the transition from the first position into the second position, cooperates with the hinge cup so that the clamping jaws are spread. The spreading element, consisting at least of the clamping jaws, of the formed spreading extensions and of the connecting flange, can thus be produced cost-effectively in one work step, for example, by injection molding. For the mounting of the furniture hinge, all that needs to be done is to attach the spreading element as a single component on the hinge cup by means of the lifting arrangement, as a result of which the assembly is substantially simplified. Due to the spreading of the clamping jaws, the latter are clamped firmly between the cup side wall and the wall of a bore in which the furniture hinge is fastened. As a result, a secure holding of the furniture hinge in the bore is achieved.

BRIEF SUMMARY OF THE INVENTION

The lifting and thus spreading movement of at least one clamping jaw can be achieved in that the lifting arrangement comprises a cam for one or both clamping, the a shaft of the cam is rotatably mounted in a cam bearing embedded in the cup side wall, and that a cam disk arranged in the periphery thereof, asymmetrically with respect to the shaft, engages in a side of the clamping jaws which faces the hinge cup, and is in contact with a pressing surface of the cam recess which faces the flange. In the first position of the lifting arrangement, the cam disk is oriented so that, with the peripheral area thereof closest to the rotation axis of the cam, it is oriented toward the pressing surface. For spreading the clamping jaws, the cam is rotated, so that the peripheral area of the cam disk farthest from the rotation axis is located opposite the pressing surface. In the process, the clamping jaw is pressed by the pressure of the cam disk on the pressing surface in the direction of the flange, as a result of which the lifting movement is achieved. The force transmission to the clamping jaws, which are preferably made plastic and thus relatively soft, by pressure is advantageous here compared to tensile loading, since there is a lower risk of damaging the clamping jaws in the process.

The lifting movement produced by the lifting arrangement can thus be converted into a spreading movement, in that, in the first position of the lifting arrangement with a spreading surface arranged at a slant relative to a lifting movement direction, the spreading extension is in contact with a transition from the cup bottom to the cup side walls, and that the spreading extension tapers in the direction towards the cup bottom to a spreading extension edge. Due to the lifting movement, which is oriented substantially along the cup side walls, the spreading extension slides along the spreading surface past the transition from the cup bottom to the cup side wall and thereby presses the clamping jaw outward. For the clamping jaw, this results in a spreading movement directed outward, away from the hinge cup, and, superposed thereon, a lifting movement in the direction toward the opening of the hinge cup, as a result of which, firstly, the furniture hinge is anchored firmly in the bore of the piece of furniture, and, secondly, the hinge cup element is advantageously pulled into the bore.

A maximum spreading of the clamping jaws can be achieved in that, in the second position of the lifting arrangement, the spreading extension edge is in contact with a cup side wall. As a result, the clamping jaws are as far as possible from the hinge cup. In this second position, the spreading extension is no longer in contact with the hinge cup by means of the slanted spreading surface, so that resetting forces, which pull the clamping jaws back into the first position thereof, are avoided.

Advantageously, the spreading extension edge is designed to be sharp-edged or rounded. In the case of an appropriate material selection, sharp edges have the advantage that, in the second position of the lifting arrangement, they can take hold in the cup side wall and thus prevent accidental shifting of the spreading element. In the case of rounded spreading extension edges, the spreading extension edges are prevented from becoming caught on the cup side wall during the spreading process. Moreover, with the pressing forces at work on the cup side wall, a rounded spreading extension edge is deformed less than a sharp edge, so that the spreading of the clamping jaws is maintained permanently.

According to a preferred design of the invention, it is possible to provide that the spreading element is made of plastic or metal or a plastic-metal composite. As a plastic component, the spreading element can be manufactured cost-effectively, for example, in a plastic injection molding process. Due to the use of plastic as a relatively soft and pliant material, a good clamping effect between the hinge cup and the bore is achieved. By means of a spreading element made of metal, high clamping forces can be generated and transmitted. By means of a plastic-metal composite, the two advantages can be combined in one component, with slightly higher manufacturing costs.

A single-piece spreading element, in which, in the mounted state of the furniture hinge, the flange is fastened outside of the bore on the piece of furniture and in which a smooth movement of the clamping jaws is possible, can be achieved in that at least one of the clamping jaws is indirectly or directly pivotably connected to the flange.

Here, a pivotable connection between the clamping jaws and the flange can be produced cost-effectively in that the clamping jaws are indirectly or directly connected via film hinges to the flange, and that the film hinges in each case comprise a first film articulation oriented toward the flange and a second film articulation oriented toward the connected clamping jaw with orientations of the rotation axes that deviate from one another. Due to the deviating orientation of the two film articulations, firstly, an easy lifting movement with a superposed spreading movement is enabled. In addition, in the production, during an injection molding process, the clamping jaws can be oriented in such a manner with respect to the flange that there are no undercuts. As a result, simple injection molds without slider can be used, which leads to low manufacturing costs.

A firmer retention of the clamping jaws in the mounting bore of a piece of furniture can be achieved in that the clamping jaws in each case comprise a cylindrical outer surface facing away from the cup side wall and/or that anchoring ribs are arranged on the outer surfaces. By means of the cylindrical outer surface, the contour of the clamping jaws is adapted to the contour of the bore, resulting in a large contact surface. When the clamping jaws are spread, the anchoring ribs produce a particularly firm retention of the furniture hinge in the bore. Due to the deformability of the anchoring ribs, diameter tolerances of the bore can be compensated in the process.

In order to achieve the lifting movement and thus the spreading movement, the clamping jaws have to be moved relative to the hinge cup element. In order to achieve a good clamping action, a certain force is needed for this purpose. The relative movement can be produced in that the lifting arrangement is fastened on the hinge cup element. The hinge cup element thus forms a counter-bearing for the lifting arrangement.

According to a preferred embodiment variant of the invention, it is possible to provide that the cam disk comprises a stopping flattened portion, in particular that the cam disk is flattened on the peripheral section thereof that is farthest from a rotation axis of the cam. Due to the flattening, firstly, an increased support surface of the cam disk with respect to the preferably also flattened pressing surface is achieved, as a result of which the contact pressure is reduced. Secondly, due to the flush or at least nearly flush contact of the cam disk on the pressing surface, the position of the cam and thus the second position of the lifting arrangement are stopped.

The actuation of the lifting arrangement can be made possible in that, in the area of the hinge cup, an actuation element is mounted, which is designed for the adjustment of the lifting arrangement. By means of the actuation element, it is possible, for example, to rotate the cam described.

For this purpose, it is possible to provide that, on the opposite side of the shaft from the cam disk, a positive-locking counter-element is formed, and that the positive-locking counter-element engages in a positive-locking element of the actuating element protruding at least partially into the hinge cup. The cam and the actuation element are connected thereby by positive locking. The cam can be rotated by a corresponding movement of the actuation element, and as a result the clamping jaws are spread.

An actuation of, for example, two facing cams on the hinge cup, can be achieved in that the actuating element is designed as a bracket arranged between the facing cup side walls of the hinge cup, with side parts extending along the cup side walls. By means of the simultaneous and uniform adjustment of the two facing cams, a uniform adjustment of the two facing clamping jaws is achieved. This leads to a uniform clamping of the furniture hinge in a bore of the piece of furniture, without the furniture hinge being shifted laterally.

According to a particularly preferred embodiment of the invention, it can be provided that, in the first position of the lifting arrangement, the bracket of the actuating element faces away from the cup bottom, and, in the second position, it is oriented facing the cup bottom. In the first, non-clamped position of the lifting arrangement, the bracket is oriented toward the cup opening of the hinge cup and thus is easily accessible from outside. For the actuation of the lifting arrangement and thus for the fastening of the furniture hinge, the bracket is rotated into the second position toward the cup bottom. Due to the design of the actuating element, in the second position, the side parts are in contact with the cup side walls, and the bracket is in contact with the cup bottom of the hinge cup. The inner space of the hinge cup is thus free for accommodating the articulated section of the hinge arm. It is advantageous that no actuation levers need to be attached outside the hinge cup. An accidental opening of the clamping device can thus be prevented. The outer design of the furniture hinge can be done freely, without having to take into consideration actuation elements. Interfering transitions and gaps, in which dirt can accumulate, for example, between the operating lever of the lifting arrangement and a flange of the furniture hinge, can be prevented. Moreover, the arrangement is intrinsically secure, since, for example, a furniture door attached via the furniture hinge can only be closed if the actuation lever is in the second position and the furniture hinge is thus fastened.

For better disengagement of the bracket from the second position thereof, it is possible to provide that the cup bottom comprises a perforation for the actuating of the actuation element and/or that the cup bottom comprises a recess or a perforation in which the bracket of the actuating element engages at least partially in the second position. In order to remove the furniture hinge, the bracket can be reached and actuated simply via the perforation. If, in addition, the perforation is designed so that the bracket in the second position thereof engages therein, or if a recess is provided, in which the bracket engages, then the actuating element and thus the lifting arrangement can be stopped in the second position.

In order to protect, in particular, the flange of a spreading element made of plastic from damage, it is possible to provide that the hinge cup comprises a flange cover protruding laterally to the cup opening thereof, that the flange cover comprises a flange recess for receiving the flange of the spreading element, and that, on the flange, on the side facing away from the flange cover, at least one centering pin is formed, which can be selected in terms of the position thereof and/or the dimension thereof. The flange cover, preferably made of metal, accommodates the flange and thus protects it thus from outer mechanical influences. By means of the centering pins, which engage in corresponding centering bores on the piece of furniture, the furniture hinge is definitively oriented with respect to the piece of furniture. Due to the selectable position and/or dimension of the at least one centering pin, by using an adapted spreading element, the furniture hinge can be used in pieces of furniture with variously arranged positions or dimensions of the centering bores. In the process, the other components of the furniture hinge remain unchanged, which achieves a cost-effective production and simultaneously a high variability of the furniture hinge.

BRIEF DESCRIPTION OF SEVERAL VIEWS OF THE DRAWINGS

The invention is explained in greater detail below in reference to an embodiment example represented in the drawings. The figures show.

DETAILED DESCRIPTION OF THE INVENTION

Figure 1:
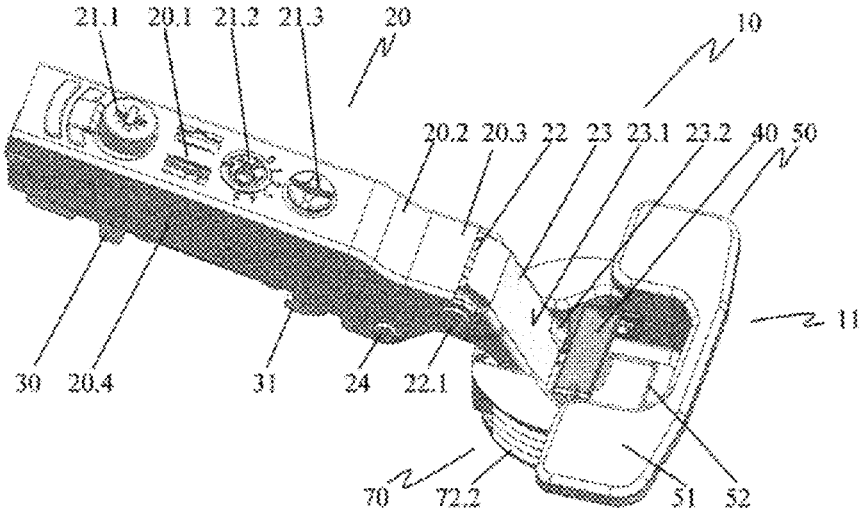
FIG. 1 in a perspective front view, a furniture hinge in a first position of a lifting arrangement, FIG. 2 in an exploded view, a stop of the furniture hinge, FIG. 3 in a perspective representation, a hinge cup element, FIG. 4 in a perspective representation, a spreading element, FIG. 5 in a perspective representation, the spreading element from FIG. 4 with an arrangement of the clamping jaws as present after an injection molding process, FIG. 6 an actuating element for a lifting arrangement, FIG. 7 in a perspective representation, a cam of the lifting arrangement, FIG. 8 in a perspective cross-sectional representation, the stop of the furniture hinge in a first position of a lifting arrangement, and FIG. 9 in a perspective cross-sectional representation, the stop of the furniture hinge shown in FIG. 8, in a second position of the lifting arrangement.

FIG. 1 shows, in a perspective front view, a furniture hinge 10 in a first position of a lifting arrangement.

A hinge arm 20 and a stop 11 are associated with the furniture hinge 10. The hinge arm 20 is connected via an articulation to a stop 11. Along a backspan 20.1 of the hinge arm 20, a depth adjusting screw 21.1, a setting element 21.2, and a support adjusting screw 21.3 are arranged. Side legs 20.4 are connected to the backspan 20.1 on both sides. The hinge arm 20 engages in a connecting element 30 which comprises connecting hooks 31. Toward the articulation, the backspan 20.1 transitions via a transition section 20.2 into a section 20.3 recessed relative to the backspan 20.1. The recessed section 20.3 is connected via an outer articulation connection 22 to an outer hinge lever 23, which comprises, oriented toward a hinge cup 52 with an actuating element 40, an actuating surface 23.1 with a protrusion 23.2. The outer articulation connection 22 is formed with an outer articulation pin 22.1 as a shaft which is led into the side legs 20.4. Correspondingly, an inner articulation pin 24 of an inner articulation pin, not shown, is held in the side legs 20.4.

The stop 11 is associated with a hinge cup element 50 having the hinge cup 52 and a flange cover 51, as well as a with a spreading element 70, of which a second clamping jaw 72.2 can be seen in the selected representation.

In the mounted state, the stop 11 is associated with a furniture door and the hinge arm 20 are associated with a body of a piece of furniture, not shown. Here, the connecting element 30 with the connecting hook 31 engages in a connecting part, not shown, fastened on the body. Via the depth adjusting screw 21.1, the setting element 21.2 and the support adjusting screw 21.3, the furniture door can be oriented relative to the body.

The actuating element 40 is part of a lifting arrangement. By rotating the actuating element 40, a lifting and spreading movement of the second clamping jaw 72.2 and of a first clamping jaw 72.1 shown in FIG. 2 is brought about, by means of which the stop 11 is fastened on the furniture door.

Figure 2:
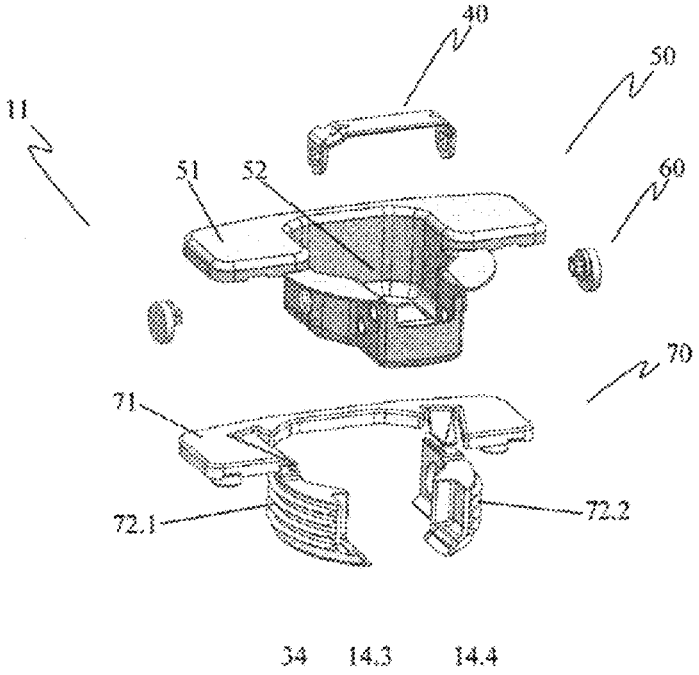

FIG. 2 shows the stop 11 of the furniture hinge 10 in an exploded view. The stop 11 is associated with the actuating element 40, the hinge cup element 50, two cams 60 as well as the spreading element 70. The hinge cup element 50 is formed substantially by a flange cover 51 and the hinge cup 52. In the spreading element 70, the first clamping jaw 71.1 and the second clamping jaw 71.2 are movably connected to a flange 71. Here, the clamping jaws 71.1, 71.2 are shaped so that they at least partially radially encompass the hinge cup 52 in the assembled state of the furniture hinge 10. The actuating element 40 is designed so that it is arranged entirely in the hinge cup 52 in the assembled state.

Figure 3:
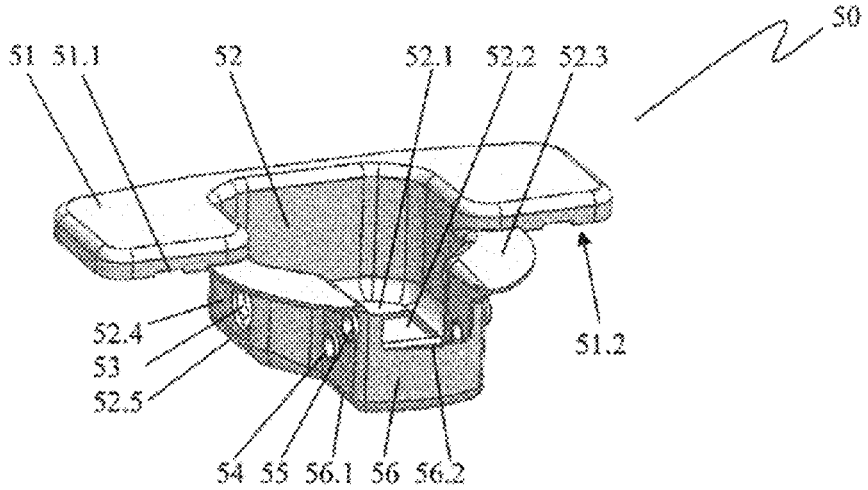

In a perspective representation, FIG. 3 shows the hinge cup element 50 with the hinge cup 52 and the flange cover 51 connected to the hinge cup 52 so as to form a single piece. The hinge cup element 50 is made of metal.

The flange cover 51 is designed substantially flat with two support areas arranged laterally to the hinge cup 52, and in each case a tool recess 51.1 is formed on them. The flange cover 51 encompasses approximately half the periphery of the hinge cup 52. It is open downward and thereby forms a flange recess 51.2 toward the piece of furniture. The hinge cup 51 is formed by cup side walls 52.4 and a cup bottom 52.1 with a transition implemented in the shape of a cup rounding 52.5. In the cup bottom 52.1, a rectangular recess 52.2 is provided. Adjoining the flange cover 51, the cup side walls 52.4 of the hinge cup 52 are closed off by contact surfaces 52.3, which are oriented in the plane of the flange cover 51. On the opposite side from the flange cover 51, an articulation receiving housing 56 is arranged as part of the hinge cup 52, the side walls of which also transition through a housing rounding 56.1 into the cup bottom 52.1. The articulation receiving housing 56 has a housing recess 56.2 toward the cup opening. On the cup side walls 52.4 of the articulation receiving housing 56, an outer articulation pin bearing 54 and an inner articulation pin bearing 55 in the form of perforations arranged so they face one another are provided. Two additional facing perforations form cam bearings 53.

The hinge cup element 50 is designed to form a mobile connection to the hinge arm 20 via the articulation pin bearing 54, 55. Here, the hinge cup 52 forms a recess for one end of the hinge arm 20 with furniture door closed. When the furniture door is open, the hinge arm 20 is led through the housing recess 56.2 of the articulation receiving housing 56 into the hinge cup 52.

Figure 4:
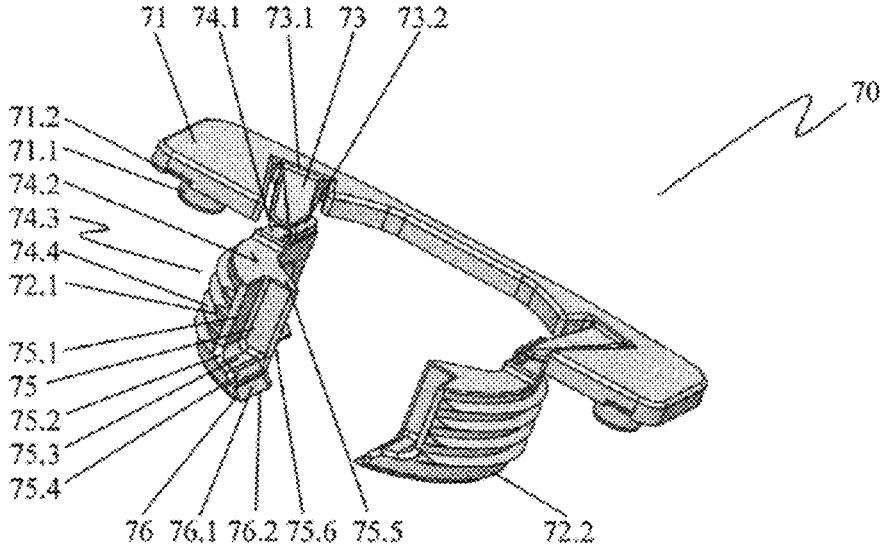

In a perspective representation, FIG. 4 shows the spreading element 70, with the substantially flat designed flange 71 and the two clamping jaws 72.1, 72.2. The spreading element 70 is made of plastic. On the flange 71, on each side, a centering pin 71.1 and an insertion notch 71.2 for a tool are provided in each case. The clamping jaws 72.1, 72.2, starting from the upper sides thereof, are connected via film hinges 73 to the flange 71. The film hinges 73 here respectively comprise a first film articulation 73.1 oriented toward the flange 71 and a second film articulation 73.2 oriented toward the respective clamping jaw 72.1, 72.2.

The clamping jaws 72.1, 72.2 are constructed mirror symmetrically in the embodiment example, so that, for the simplified representation, the identifier in each case is marked on only one of the clamping jaws 72.1, 72.2. The film hinges 73 are formed on front-face fastening surfaces 74.1 of the clamping jaws 72.1, 72.2, surfaces which are oriented toward the flange 71. The fastening surface 74.1 transitions into a recessed support surface 74.2. Directed radially outward, the clamping jaws 72.1, 72.2 comprise cylindrically shaped outer surfaces 74.3, along which anchoring ribs 74.4 are arranged. On the opposite side from the flange 71, the clamping jaws 72.1, 72.2 in each case comprise an articulation pin recess 75 in the form of a recess. The articulation pin recesses 75 are in each case formed by a side surface 75.1, which transitions via a rounding section 75.2 into a recess bottom 75.3, and a ridge 75.5 with a ridge edge 75.6. The recess bottom 75.3 ends in a bevel 75.4, which ends with the ridge edge 75.6 of the ridge 75.5.

The clamping jaws 72.1, 72.2 are arranged facing so that the articulation pin recesses 75 with the ridges 76 face one another at a distance. On the undersides of the clamping jaws 72.1, 72.2, under the articulation pin recesses 75, front spreading extensions 76 are arranged. The front spreading extensions 76 have a substantially triangular shape and thus form a front spreading surface 76.1, which transitions into the bevel 75.6 of the articulation pin recess 75, and a front spreading extension edge 76.2. The front spreading surfaces 76.1 of the two clamping jaws 72.1, 72.2 face one another at a distance. Here, they project relative to the ridge edges 75.6 of the ridges 75.5.

The spreading element 70 is shaped so that the flange 71 thereof can be introduced into the flange recess 51.2 of the flange cover 51 of the hinge cup element 50 shown in FIG. 3 and covered thereby. When mounted, the two clamping jaws 72.1, 72.2 enclose the hinge cup 52 over a portion of the cup side walls 52.4. The two film hinges 73 enable a simple and smooth pivoting of the clamping jaws 72.1, 72.2 away from the hinge cup 52.

Figure 5:
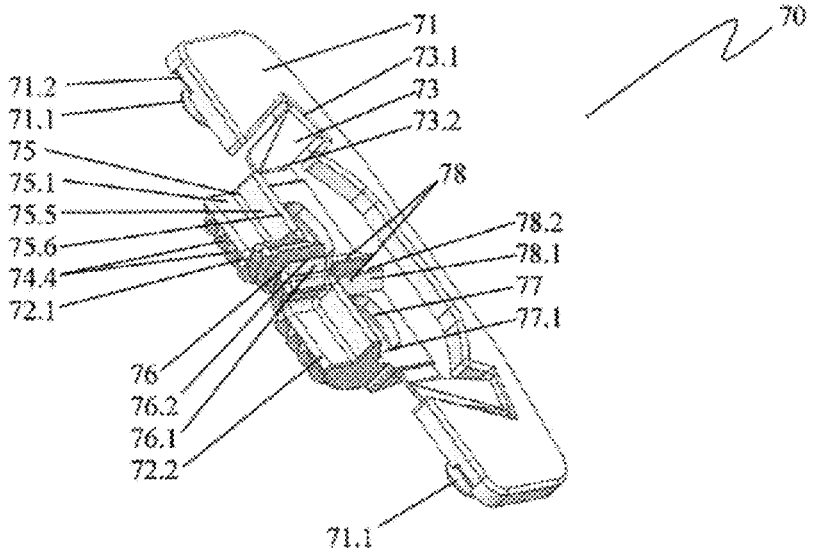

In a perspective representation, FIG. 5 shows the spreading element 70 from FIG. 4 with an arrangement of the clamping jaws 72.1, 72.2 as present after an injection molding process. Accordingly, identical components are labeled identically.

Compared to the representation in FIG. 4, the clamping jaws 72.1, 72.2 are pivoted on the second film articulations 73.2 of the film hinges 73 so that they face one another with their undersides. In addition to the components already described in FIG. 4, in FIG. 5, two rear spreading extensions 78 can be seen, which are each arranged on the side of the clamping jaws 72.1, 72.2 facing away from the film hinge 73. The spreading extensions 78 have a substantially triangular contour, as a result of which rear spreading surfaces 78.1 extending at a slant are formed. In the orientation of the clamping jaws 72.1, 72.2 shown in FIG. 4, the rear spreading extensions 78 with formed rear spreading extension edges 78.2 face in the direction of the hinge cup 52. Here, the rear spreading surfaces 78.1 are in the same plane as the front spreading surfaces 76.1.

Between the film hinges 73 and the rear spreading extensions 78, cam recesses 77 are formed in the clamping jaws 72.1, 72.2. The cam recesses 77 comprise flattened pressing surfaces 77.1 on the side of the film hinge 73.

In the orientation of the clamping jaws 72.1, 72.2 shown in FIG. 5, the spreading element 70 has no undercuts in the direction of the surface normal of the flange 71. The spreading element 70 can thus be produced correspondingly inexpensively in a plastic injection molding process with a relatively simple injection mold without slider.

Figure 6:
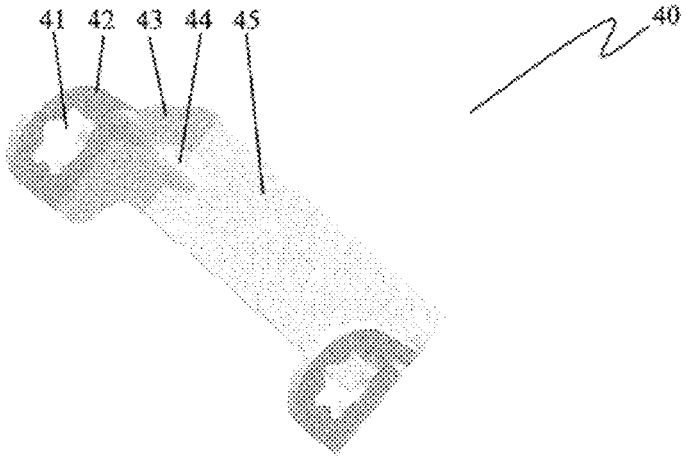

FIG. 6 shows the actuating element 40 for the lifting arrangement. The actuating element 40 is formed by a bracket 45 and two side parts 42 arranged angled thereto. The transition from the bracket 45 to the side parts 42 occurs via two transition sections 73 arranged at a slant. The edges between the bracket 45 and the transition section 73 as well as between the transition section 73 and the side parts 42 are reinforced by embossings 44. In the side parts 42, positive-locking elements 41 in the form of star-shaped perforations are arranged, which face one another along a rotation axis which is not shown. In order to establish a definitive peripheral position of the positive-locking elements 41, in each case one tooth of the star-shaped perforations is not formed.

Figure 7:
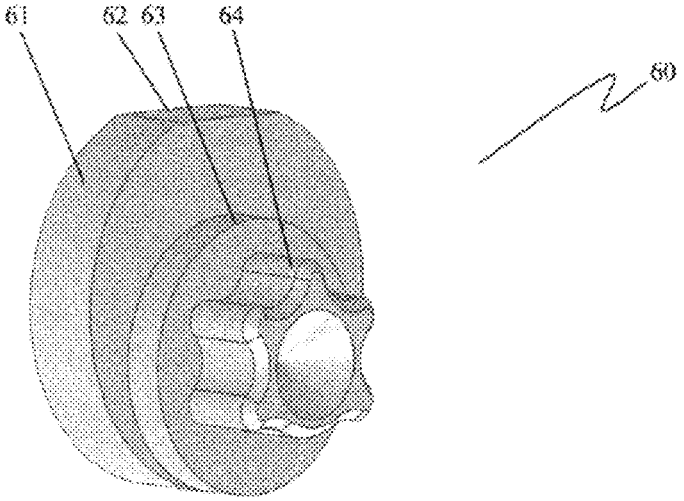

In a perspective representation, FIG. 7 shows the cam 60 of the lifting arrangement. The cam 60 is formed as a single piece by a positive-locking counter-element 64, a connected shaft 63 and a cam disk 61. The shaft 63 is designed in the shape of a cylinder, wherein the central axis of the shaft 63 forms a rotation axis of the cam 60. The outer diameter of the shaft 63 is designed so that the cam 60 can be rotatably mounted with the shaft 63 in the cam bearing 53 shown in FIG. 3 in the cup side wall 52.4 of the hinge cup 52. Here, the cam 60 is oriented so that the positive-locking counter-element 64 protrudes into the hinge cup 52 and the cam disk 61 protrudes into the cam recess 77 of the spreading element 70 shown in FIG. 5.

The cam disk 61 is oriented eccentrically relative to the rotation axis of the cam 60. It has a flattened portion 62 on its peripheral section farthest from the rotation axis.

The positive-locking counter-element 64 is adapted in terms of the peripheral contour thereof to the star shape of the positive-locking elements 41 of the actuating element 40, which are shown in FIG. 6, wherein, again, one tooth of the star-shaped contour is omitted.

Figure 8:
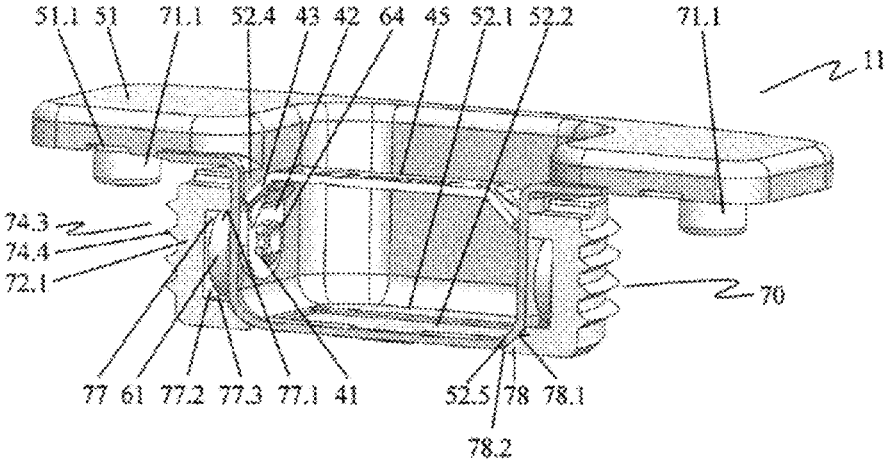

FIG. 8 shows, in a perspective cross-sectional representation, the stop 11 of the furniture hinge 10 in a first position of the lifting arrangement in the assembled state. The clamping jaws 72.1, 72.2 of the spreading element 70 are arranged in contact with the hinge cup 52. The cams 60 are mounted with the shafts 63 thereof in the cam bearings 53 of the hinge cup element 50 shown in FIG. 3. The actuating element 40 engages with the positive-locking elements 41 thereof in the positive-locking counter-elements 64 of the cam 60 and thus form positive-locking connections with the cams 60. The actuating element 40 is arranged entirely within the hinge cup 52.

The cam disks 61 are introduced into the cam recesses 77 of the clamping jaws 72.1, 72.2. The cam recesses 77 are implemented here in the form of recesses in the clamping jaws 72.1, 72.2, each with a pressing surface 77.1 oriented in the direction of the flange 71, with a side wall 77.2 and with a bottom surface 77.3 facing the pressing surface 77.1. The cam disks 61, on the peripheries thereof, contact the pressing surfaces 77.1 of the cam recesses 77.

The flange 71 of the spreading element 70 is introduced into the flange recess 51.2 of the flange cover 51 and covered thereby. The centering pins 71.1 point in the direction facing away from the flange cover 51.

The cams 60, together with the cam bearings 53 of the hinge cup elements 50 and with the actuating element 40, form the lifting arrangement. In the depicted first position of the lifting arrangement, the bracket 45 of the actuating element 40 is oriented toward the opening of the hinge cup 52. As a result of the respective missing tooth in the star-shaped contours of the positive-locking elements 41 of the actuating element 40 and of the positive-locking counter-elements 64 of the cam 60, there is a clear orientation of the cam 60 with respect to the actuating element 40. In the first position of the lifting arrangement, the cams 60 are rotated so that the cam disks 61, with the flattened areas thereof farthest from the rotation axis, point in the direction of the bottom surfaces 77.3 of the cam recesses 77. In this position, the clamping jaws 72.1, 72.2 with the rear spreading surfaces 78.1 of the rear spreading extensions 78 thereof are in contact with the cup rounding 52.5 in the transition from the cup side walls 52.4 to the cup bottom 52.1. Accordingly, not shown, the front spreading surfaces 76.1 of the front spreading extensions 76, which are shown in FIG. 4, are in contact with the housing rounding 56.1 in the transition from the cup side walls 52.4 in the area of the articulation receiving housing 56 to the cup bottom 52.1 in this area.

In the assembly of the stop 11 in the production of the furniture hinge 10, first the actuating element 40 is introduced into the hinge cup 52 and the cams 60 are inserted through the cam bearing 53 into the positive-locking elements 41 of the actuating element 40. The actuating element 40 is brought into the first position. Subsequently, the spreading element 70 is shifted over the hinge cup 52, so that the cams 60 are received in the cam recesses 77, and the flange 71 is received in the flange recess 51.2 of the flange cover 51. When the spreading element 70 is shifted onto the hinge cup 52, the clamping jaws 72.1, 72.2 are pivoted from their fabrication position shown in FIG. 5 into the mounting position shown in FIGS. 4 and 8.

In the first position of the lifting arrangement, the clamping jaws 72.1, 72.2 are not spread, so that the hinge cup 52 with the clamping jaws 72.1, 72.2 can be introduced into a corresponding bore in a furniture door. The correct radial orientation of the furniture hinge 10 is here ensured by the centering pins 71.1, which engage in centering bores, which are correspondingly provided on the furniture door.

Figure 9:
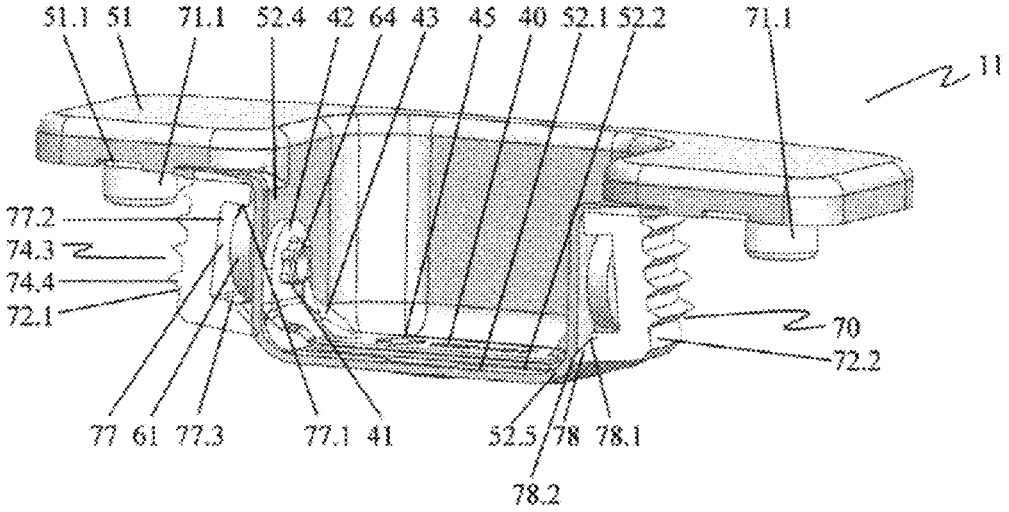

FIG. 9 shows, in a perspective cross-sectional representation, the stop 11 of the furniture hinge 10, which is shown in FIG. 8, in a second position of the lifting arrangement.

In comparison to the first position of the lifting arrangement shown in FIG. 8, the actuating element 40 is adjusted, so that the bracket 45 faces the cup bottom 52.1 of the hinge cup 52. The bracket 45 is here arranged partially in the recess 52.2 of the cup bottom 52.1. In this position of the actuating element 40, the flattened portions 62 of the cam disks 61 of the cams 60 connected with positive lock to the actuating element 40 point in the direction of the pressing surfaces 77.1 of the cam recesses 77. The areas of the flattened portions 62 of the cam disks 61 are the farthest from the rotation axes of the cams 60. Due to the rotation of the actuating element 40 and thus of the cams 60 from the first position shown in FIG. 8 into the second position shown in FIG. 9, the clamping jaws 72.1, 72.2 are therefore moved in a lifting movement in the direction toward the flange 71 and the flange cover 51. Due to the rear spreading surfaces 78.1 of the rear spreading extensions 78, which are arranged at a slant with respect to the lifting movement, and due to the front spreading surfaces 76.1 of the front spreading extensions 76, which are shown in FIG. 4, the clamping jaws 72.1, 72.2 pressed by the cup roundings 52.5 or respectively the house roundings 56.1 of the hinge cup 52, so that, due to the lifting movement, an additional spreading movement of the clamping jaws 72.1, 72.2 is forced. The superposed lifting and spreading movement of the clamping jaws 72.1, 72.2 is enabled by the film hinge 73 and the arrangement of the film articulations 73.1, 73.2.

Due to the spreading movement, the clamping jaws 72.1, 72.2 are pressed against the wall of a bore, in which the furniture hinge 10 is to be mounted. As a result, the stop 11 is fastened in the bore. In the process, the anchoring ribs 74.4 lead to a connection between the clamping jaws 72.1, 72.2 and the bore wall, which is able to withstand stress.

Due to the lifting movement which is superposed on the spreading, the hinge cup element 50 is pulled in the direction of the bore of the piece of furniture, so that the flange cover 51 and the contact surfaces 52.3 on the margin of the bore are pressed firmly on the surface of the piece of furniture. Together with the centering pins 71.1 inserted into the corresponding centering bores, an accurate positioning of the stop 11 and thus of the furniture hinge 10 is thus achieved.

The design of the lifting arrangement with cams 60 has the advantage that, by an appropriate selection of the cam disks 61, a relatively large lifting movement of the clamping jaws 72.1, 72.2 can be achieved. In this way, the clamping jaws 72.1, 72.2 can be lifted to the point that the spreading extension edges 76.2, 78.2 of the front and rear spreading extensions 76, 78 are in contact with the cup side walls 52.4, as a result of which a maximum spreading of the clamping jaws 72.1, 72.2 is achieved. Moreover, in the second position of the lifting arrangement, the spreading extensions 76, 78 are no longer in contact, by the spreading surfaces 76.1, 78.1 thereof, which are oriented at a slant, with the cup roundings 52.5 or respectively housing roundings 56.1, so that, due to the radially inward directed forces acting from outside on the clamping jaws 72.1, 72.2, no resetting forces, which pull the clamping jaws 72.1, 72.2 again back into the first position thereof, are generated. Another advantage of a large lifting movement in comparison to a smaller one results from the fact that the spreading surfaces 76.1, 76.2, with identical achievable spreading of the clamping jaws 72.1, 72.2, can have a greater inclination. As a result, the pressures acting between the hinge cup 52 and the spreading extensions 76, 78 can be kept small. Conversely, with identical inclination of the spreading surfaces 76.1, 76.2, a greater spreading movement is possible.

The second position of the lifting arrangement is stopped by the flattened portions 62 of the cam disks 61, which are in contact with the pressing surfaces 77.1 of the clamping jaws 72.1, 72.2. Due to the flattened portions 62, an unintended rotation of the cams 60 is prevented. An additional stopping of the lifting arrangement in the second position is achieved by the recess 52.2 in the cup bottom 52.1, in which the bracket 45 of the actuating element engages at least partially. Alternatively, it is possible to provide that the recess 52.2 is implemented as a perforation, in which the bracket 45 engages at least partially. This makes possible, firstly, the described stopping of the lifting arrangement, and, secondly, the bracket 45 can be reached and actuated via the perforation, for example, for the removal of the furniture hinge 10. In another alternative embodiment, in addition to the recess 52.2, a perforation can be arranged in the cup bottom 52.2, through which the bracket 45 can be actuated. The additional perforation can be provided within the recess 52.2 or laterally thereto.

Since the actuating element 40 is arranged entirely in the hinge cup 52, an unintended opening of the clamping device can be ruled out. Moreover, due to the flange cover 51, a uniform surface of the hinge cup element 50 without interfering operating elements can be produced.

In order to remove the furniture hinge 10, the actuating element 40 and thus the lifting arrangement are rotated back into the first position thereof, so that the bracket 45 is again oriented in the direction of the opening of the hinge cup 52. The clamping jaws 72.1, 72.2 are pressed back in the process by the pressure of the cam disks 61 onto the bottom surfaces 77.3 of the cam recesses 77 into the first position thereof, shown in FIG. 8, and the clamping is released.

As explained in reference to FIG. 5, the spreading element 70 can be produced cost-effectively as an injection molded part made of plastic. In the process, the positions and the dimensions of the centering pins 71.1 can be specified differently for different spreading elements 70. In this way, by selecting a matching spreading element 70, the furniture hinge 10 can be adapted to different bore arrangements present in different pieces of furniture, without having to change the rest of the components of the furniture hinge 10.

The invention claimed is:

1. A furniture hinge (10) with a hinge cup (52) having cup side walls (52.4) which encircle a cup opening at least partially, and having a cup bottom (52.1) which at least partially closes off the hinge cup (52) opposite the cup opening, with a spreading element (70) having two clamping jaws (72.1, 72.2) which at least partially radially enclose the cup side walls (52.4) of the hinge cup (52) and which are connected via a flange (71), a lifting arrangement comprising a cam (60) having a cam disk (61), a cam recess (77) including a pressing surface (77.1), and a shaft (63) rotatably mounted in a cam bearing (53) for adjusting at least one of the clamping jaws (72.1, 72.2) between a first position and a second position, wherein the cam bearing (53) is embedded in the cup side wall (52.4) with the cam disk (61) arranged on the periphery thereof, asymmetrically with respect to the shaft (63), the cam disk (61) engages in the cam recess (77) formed in a side of the clamping jaws (72.1, 72.2) which faces the hinge cup (52), and is in contact with the pressing surface (77.1) of the cam recess (77) which faces away from the flange (71); and wherein at least one of the clamping jaws (72.1, 72.2) comprises at least one integrally formed spreading extension (76, 78) which includes a spreading surface (76.1, 78.1) arranged at a slant relative to the clamping jaws (72.1, 72.2), thereby upon rotation of said cam (60), said slant in cooperation with the hinge cup, provokes a spreading movement of the clamping jaws (72.1, 72.2) caused by the lifting movement of the clamping jaws (72.1, 72.2) in a transition from the first position to the second position.

2. The furniture hinge (10) according to claim 1, wherein in the first position, the spreading extension (76, 78) is in contact with a transition from the cup bottom (52.1) to the cup side walls (52.4), and the spreading extension tapers in the direction towards the cup bottom (52.1) to a spreading extension edge (76.2, 78.2).

3. The furniture hinge (10) according to claim 2, wherein in the second position, the spreading extension edge (76.2, 78.2) is in contact with a cup side wall (52.4).

4. The furniture hinge (10) according to claim 2 wherein the spreading extension edge (76.2, 78.2) is designed as sharp-edged or rounded.

5. The furniture hinge (10) according to claim 1, wherein the spreading element (70) is made of plastic or metal or a plastic-metal composite.

6. The furniture hinge (10) according to claim 1, wherein at least one of the clamping jaws (72.1, 72.2) is indirectly or directly pivotably connected to the flange (71).

7. The furniture hinge (10) according to claim 6, wherein the clamping jaws (72.1, 72.2) are connected indirectly or directly via film hinges (73) to the flange (71) and that the film hinges (73) in each case comprise a first film articulation (73.1) oriented toward the flange (71) and a second film articulation (73.2) oriented toward the connected clamping jaws (72.1, 72.2) with orientations of the rotation axes that deviate from one another.

8. The furniture hinge (10) according to claim 1, wherein the clamping jaws (72.1, 72.2) in each case comprise a cylindrical outer surface (74.3) facing away from the cup side wall (52.4) and/or that anchoring ribs (74.4) are arranged on the outer surfaces (74.3).

9. The furniture hinge (10) according to claim 1, wherein characterized in that the lifting arrangement is fastened to the hinge cup (52).

10. The furniture hinge (10) according to claim 1, wherein the cam disk (61) comprises a stopping flattened portion (62), in particular that the cam disk (61) is flattened on the peripheral section thereof farthest from a rotation axis of the cam (60).

11. The furniture hinge (10) according to claim 10, wherein in the area of the hinge cup (52), an actuating element (40) is mounted, which is designed for the adjustment of the lifting arrangement by rotation of actuating element (40); and on the opposite side of the shaft (63) from the cam disk (61), a positive-locking counter-element (64) is formed, and that the positive-locking counter-element (64) engages in a positive-locking element (41) of the actuating element (40) protruding at least partially into the hinge cup (52).

12. The furniture hinge (10) according to claim 1, wherein in the area of the hinge cup (52), an actuating element (40) is mounted to said cam (60), said actuating element (40) is designed for the adjustment of the lifting arrangement by rotation of actuating element (40).

13. The furniture hinge (10) according to claim 12, wherein the actuating element (40) is designed as a bracket (45) arranged between facing cup side walls (52.4) of the hinge cup (52), with side parts (42) extending along the cup side walls (52.4).

14. The furniture hinge (10) according to claim 13, wherein in the first position, the bracket (45) of the actuating element (40) is oriented facing away from the cup bottom (52.1), and, in the second position, it is oriented facing the cup bottom (52.1).

15. The furniture hinge (10) according to claim 13, wherein the cup bottom comprises a perforation for the actuation of the actuating element (40) and/or that the cup bottom (52.1) comprises a recess (52.2) which comprises a perforation in which the bracket (45) of the actuating element (40) engages at least partially in the second position.

16. The furniture hinge (10) according to claim 1, wherein the hinge cup (52) comprises a flange cover (51) protruding laterally to the cup opening thereof, that the flange cover (51) comprises a flange recess (51.2) for accommodating the flange (71) of the spreading element (70), and that, on the flange (71), on the side facing away from the flange cover (51), at least one centering pin (71.1) is formed.

* * * * *